US007300479B2

(12) United States Patent
McArdle et al.

(10) Patent No.: US 7,300,479 B2
(45) Date of Patent: Nov. 27, 2007

(54) COMPOSITIONS FOR ABRASIVE ARTICLES

(75) Inventors: James L. McArdle, Stillwater, MN (US); Scott R. Culler, Burnsville, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/668,753

(22) Filed: Sep. 23, 2003

(65) Prior Publication Data

US 2005/0060947 A1 Mar. 24, 2005

(51) Int. Cl.
*B24D 3/00* (2006.01)
*B24D 11/00* (2006.01)

(52) U.S. Cl. ..... 51/298; 51/295; 51/307; 51/309; 451/28

(58) Field of Classification Search ..... 51/298, 51/295, 307, 308, 309; 451/28
See application file for complete search history.

(56) References Cited

U.S. PATENT DOCUMENTS

| | | | |
|---|---|---|---|
| 3,594,865 | A | 7/1971 | Erb |
| 3,898,772 | A | 8/1975 | Sawluk |
| 4,311,489 | A | 1/1982 | Kressner |
| 4,314,827 | A | 2/1982 | Leitheiser et al. |
| 4,518,397 | A | 5/1985 | Leitheiser et al. |
| 4,623,364 | A | 11/1986 | Cottringer et al. |
| 4,644,703 | A | 2/1987 | Kaczmarek et al. |
| 4,652,274 | A | 3/1987 | Boettcher et al. |
| 4,652,275 | A | 3/1987 | Bloecher et al. |
| 4,735,632 | A | 4/1988 | Oxman et al. |
| 4,751,138 | A | 6/1988 | Tumey et al. |
| 4,773,920 | A | 9/1988 | Chasman et al. |
| 4,799,939 | A | 1/1989 | Bloecher et al. |
| 4,881,951 | A | 11/1989 | Wood et al. |
| 4,903,440 | A | 2/1990 | Larson et al. |
| 4,959,265 | A | 9/1990 | Wood et al. |
| 4,964,883 | A | 10/1990 | Morris et al. |
| 4,985,340 | A | 1/1991 | Palazzotto et al. |

(Continued)

FOREIGN PATENT DOCUMENTS

| | | |
|---|---|---|
| DE | 293 300 A5 | 8/1991 |

(Continued)

OTHER PUBLICATIONS

ANSI B74, 18-1996 "For Grading of Certain Abrasive Grain on coated Abrasive Material".

(Continued)

*Primary Examiner*—Michael Marcheschi

(57) ABSTRACT

A structured abrasive article, methods of making an abrasive article, and methods of using an abrasive article. The abrasive composites forming the abrasive article have a height of at least 500 micrometers, and the abrasive particles in the composites have an average particle size of at least 40 micrometers, in some embodiments, at least about 85 micrometers. The large topography composites, together with the large ceramic abrasive particles, provides an abrasive article that has a more consistent cut, a longer cutting life, and a more consistent surface finish than conventional make/coat abrasive articles with the same size and type of abrasive particles. Additionally, the large topography composites, together with the large ceramic abrasive particles, provide an abrasive article that has a more consistent cut, a longer cutting life, and a more consistent surface finish than structured abrasive articles having a smaller topography, even with the same abrasive particles.

27 Claims, 3 Drawing Sheets

U.S. PATENT DOCUMENTS

| | | | | |
|---|---|---|---|---|
| 5,014,468 | A | | 5/1991 | Ravipati et al. |
| 5,015,266 | A | | 5/1991 | Yamamoto |
| 5,039,311 | A | | 8/1991 | Bloecher |
| 5,061,294 | A | | 10/1991 | Harmer et al. |
| 5,077,870 | A | | 1/1992 | Melbye et al. |
| 5,137,542 | A | | 8/1992 | Buchanan et al. |
| 5,152,917 | A | | 10/1992 | Pieper et al. |
| 5,201,101 | A | | 4/1993 | Rouser et al. |
| 5,201,916 | A | | 4/1993 | Berg et al. |
| 5,203,884 | A | | 4/1993 | Buchanan et al. |
| 5,236,472 | A | | 8/1993 | Kirk et al. |
| 5,304,223 | A | | 4/1994 | Pieper et al. |
| 5,312,789 | A | | 5/1994 | Wood |
| 5,316,812 | A | | 5/1994 | Stout et al. |
| 5,378,251 | A | | 1/1995 | Culler et al. |
| 5,435,816 | A | | 7/1995 | Spurgeon et al. |
| 5,484,330 | A | | 1/1996 | Flood et al. |
| 5,489,235 | A | | 2/1996 | Gagliardi et al. |
| 5,578,099 | A | | 11/1996 | Neff |
| 5,611,829 | A | | 3/1997 | Monroe et al. |
| 5,672,097 | A | | 9/1997 | Hoopman |
| 5,681,217 | A | * | 10/1997 | Hoopman et al. ..... 451/528 |
| 5,833,724 | A | | 11/1998 | Wei et al. |
| 5,855,632 | A | | 1/1999 | Stoetzel et al. |
| 5,863,306 | A | | 1/1999 | Wei et al. |
| 5,876,470 | A | * | 3/1999 | Abrahamson ..... 51/309 |
| 5,891,204 | A | | 4/1999 | Neff |
| 6,076,248 | A | * | 6/2000 | Hoopman et al. ..... 29/527.1 |
| 6,120,568 | A | | 9/2000 | Neff |
| 6,129,540 | A | | 10/2000 | Hoopman et al. |
| 6,194,317 | B1 | | 2/2001 | Kaisaki et al. |
| 6,224,465 | B1 | | 5/2001 | Meyer |
| 6,319,108 | B1 | | 11/2001 | Adefris et al. |
| 6,371,842 | B1 | | 4/2002 | Romero |
| 6,761,620 | B2 | | 7/2004 | Naujok |
| 6,817,936 | B1 | | 11/2004 | Skeem et al. |
| 6,821,196 | B2 | | 11/2004 | Oliver |
| 2001/0008830 | A1 | | 7/2001 | Tolles et al. |

FOREIGN PATENT DOCUMENTS

| | | |
|---|---|---|
| EP | 0 109 581 A2 | 5/1984 |
| EP | 0 306 161 A2 | 3/1989 |
| EP | 0 306 162 A2 | 3/1989 |
| EP | 0 938 950 A2 | 9/1999 |
| FR | 881.239 | 4/1943 |
| WO | WO 93/12911 A1 | 7/1993 |
| WO | WO 99/43491 | 9/1999 |
| WO | WO 01/04227 A2 | 1/2001 |
| WO | WO 01/45903 A1 | 6/2001 |
| WO | WO 02/14018 A2 | 2/2002 |

OTHER PUBLICATIONS

U.S. Application entitled "A Coated Abrasive Belt With an Endless, Seamless Backing and Method of Preparation," Benedict et al., filed Jul. 24, 1992, having U.S. Appl. No. 07/919,541.

U.S. Application entitled "A Method of Making an Abrasive Article," Spurgeon et al., filed Jan. 14, 1993, having U.S. Appl. No. 08/004,929.

U.S. Application entitled "Abrasive Article for Finishing," Hoopman et al., filed Sep. 13, 1993, having U.S. Appl. No. 08/120,300.

* cited by examiner

COMPOSITIONS FOR ABRASIVE ARTICLES

FIELD OF THE DISCLOSURE

This disclosure is directed to an abrasive article, particularly a structured abrasive article, methods of making, and methods of using. More specifically, the structured abrasive article has a large topography and includes large ceramic abrasive particles.

BACKGROUND

Abrasive articles have been utilized to abrade and finish workpieces surfaces for well over a hundred years. These applications have ranged from high stock removal, high pressure metal grinding processes to fine polishing, such as of ophthalmic lenses. In general, abrasive articles are made of a plurality of abrasive particles bonded either together (e.g., a bonded abrasive or grinding wheel) or to a backing (e.g., a coated abrasive). For a coated abrasive there is typically a single layer, or sometimes two layers, of abrasive particles. Once these abrasive particles are worn, the coated abrasive is essentially worn out and is typically discarded.

One solution to this single layer of abrasive particles is described U.S. Pat. No. 4,652,275 (Bloecher et al.); U.S. Pat. No. 4,799,939 (Bloecher et al.) and U.S. Pat. No. 5,039,311 (Bloecher). The coated abrasive articles that are disclosed in these references have a plurality of abrasive agglomerates bonded to a backing. The abrasive agglomerate is a shaped mass comprising abrasive particles, a binder, optionally a grinding aid, and optionally other additives. These abrasive agglomerates essentially result in a three dimensional coating of abrasive particles forming the abrasive article.

Another three dimensional coating of abrasive particles is an abrasive lapping film. A lapping film, like that disclosed in U.S. Pat. No. 4,644,703 (Kaczmarek et al.), U.S. Pat. No. 4,773,920

Another three dimensional coating of abrasive particles is an abrasive lapping film. A lapping film, like that disclosed in U.S. Pat. No. 4,644,703 (Kaczmarek et al.), U.S. Pat. No. 4,773,920 (Chasman et al.) and U.S. Pat. No. 5,015,266 (Yamamoto), is made from an abrasive slurry comprising abrasive particles and a binder, which is bonded to a backing. Although these lapping films have had wide commercial success in polishing applications where a fine surface finish on a workpiece is desired, these lapping films do not always have the desired rate of cut for many other applications.

A more recent development in three dimensional coatings of abrasive particles has provided abrasive articles often referred to as "structured abrasives". Various constructions of structured abrasive articles are disclosed, for example, in U.S. Pat. No. 5,152,917 (Pieper et al.). Pieper teaches a structured abrasive that results in a relatively high rate of cut and a relatively fine surface finish on the workpiece surface. The structured abrasive comprises non-random, precisely shaped abrasive composites that are bonded to a backing. Other references directed to structured abrasive articles and methods of making them include U.S. Pat. No. 5,855,632 (Stoetzel et al.), U.S. Pat. No. 5,681,217 (Hoopman et al.), U.S. Pat. No. 5,435,816 (Spurgeon et al.), U.S. Pat. No. 5,378,251 (Culler et al.), U.S. Pat. No. 5,304,223 (Pieper et al.), and U.S. Pat. No. 5,014,468 (Ravipati et al.). Pieper, and the other structure abrasive patents, are a significant advancement in the abrasives art, however there is always room for improvement for large stock removal and extended life.

SUMMARY

The present application is directed to a structured abrasive article, methods of making an abrasive article, and methods of using an abrasive article. In particular, the abrasive article is a structure abrasive article composed of a plurality of three-dimensional abrasive composites, each composite comprising abrasive particles in binder. Specifically, the composites are "large" composites, having a height of at least 500 micrometers (0.02 inch). Additionally, the abrasive particles in the composites are "large" ceramic abrasive particles having an average particle size of at least 40 micrometers. In some embodiments, the abrasive particles have an average particle size of at least about 85 micrometers. In further embodiments, the abrasive particles in the composites are "coarse" ceramic particles having an average particle size of at least 100 micrometers. In some embodiments, the ceramic particles used have an average particle size of at least 400 micrometers.

The large topography composites, together with the large ceramic abrasive particles, provides an abrasive article that has a more consistent cut, a longer cutting life, and a more consistent surface finish than conventional make/coat abrasive articles with the same size and type of abrasive particles. Additionally, the large topography composites, together with the large ceramic abrasive particles, provide an abrasive article that has a more consistent cut, a longer cutting life, and a more consistent surface finish than structured abrasive articles having a smaller topography, even with the same abrasive particles.

In one particular embodiment, the present invention is directed to a structured abrasive article comprising a backing having a front face and a plurality of abrasive composites on the front face. Each of the abrasive composites has a plurality of ceramic abrasive particles having an average particle size of at least 85 micrometers, and an organic constituent comprising radiation curable binder, the organic constituent occupying 15-40 wt-% of the abrasive composite. The composites have a height, measured from the front face of the backing, of at least 500 micrometers. The abrasive article, in use, produces a first cut rate and a first surface finish at a first time and a second cut rate and a second surface finish at a second time, the first time and the second time being separated by at least 20 minutes, with the second cut rate being no more than 50% less than the first cut rate. In some embodiments, the second cut rate is no more than 30% less than the first cut rate, and even no more than 15% less.

The ceramic abrasive particles can have an average particle size of at least 100 micrometers, of at least about 200 micrometers, or of about 100-400 micrometers. The ceramic abrasive particles can be seeded or non-seeded. Additionally or alternatively, the ceramic abrasive particles can include at least one rare earth oxide modifier, such as an oxide of yttrium, neodymium, lanthanum, cobalt, and magnesium.

The height of the abrasive composites, measured from the front face of the backing, can be at least 600 micrometers, or at least 750 micrometers. This height can be defined at least partially by a parabolic function. The parabolic function can include a square root function.

The present invention is directed to various structured abrasive articles for grinding a surface having a plurality of abrasive composites having a height of at least 500 micrometers and comprising ceramic abrasive particles having an average particle size of at least 85 micrometers dispersed in a binder. In one embodiment, the abrasive article is constructed for grinding the surface at a first time to obtain a first cut rate and a first surface finish, and grinding the surface at a second time 20 minutes after the first time to obtain a second cut rate being no greater than 50% less than the first cut rate. In other embodiments, the abrasive article is constructed for grinding the surface at a second time to obtain a second cut rate being no greater than 30% less than the first cut rate, or, grinding the surface at a second time to obtain a second cut rate being no greater than 15% less than the first cut rate. Additionally or alternatively, the second time can be 30 minutes after the first time. In another embodiment, the grinding includes using Test Procedure I to produce a first cut rate at Cycle 1 and a second cut rate at Cycle 240, the second cut rate being no greater than 15% less than the first cut rate. In yet another embodiment, the grinding includes using Test Procedure II to produce a first cut rate at Cycle 1 and a second cut rate at Cycle 12, the second cut rate being no greater than 50% less than the first cut rate. In a further embodiment, the grinding includes using Test Procedure III to produce a first cut rate at Cycle 1 and a second cut rate at Cycle 30, the second cut rate is no greater than 30% less than the first cut rate.

And further, the invention includes a structured abrasive article that provides a more consistent cut rate than a benchmark abrasive article, such as a conventional coated abrasive with make and size coats and gravity deposited fused aluminum oxide abrasive particle agglomerates. When using Test Procedure III, the structured abrasive article has a cut rate decrease over 30 cycles of no more than 50% of a comparative cut rate decrease.

The invention is also directed to methods of making a structured abrasive article. The steps include providing a backing having a front face and applying a plurality of abrasive composites on the front face. Each of the abrasive composites comprise a plurality of ceramic abrasive particles having an average particle size of at least 85 micrometers, and an organic constituent comprising radiation curable binder, the organic constituent occupying 15-40 wt % of the abrasive composite. The composites having a height, measured from the front face of the backing, of at least 500 micrometers. The method can also include providing a slurry comprising a binder precursor and the plurality of ceramic abrasive particles dispersed therein, providing a production tool having a plurality of cavities therein, coating the slurry into the cavities, contacting the slurry with the backing front face, curing the binder precursor, and removing the slurry from the production tool.

The binder precursor can be cured before the slurry is removed from the production tool, or, the slurry can be removed before it is cured. Likewise, the slurry can be coated into the cavities before the slurry is contacted with the backing front face, or, after.

DETAILED DESCRIPTION

Figure 1:
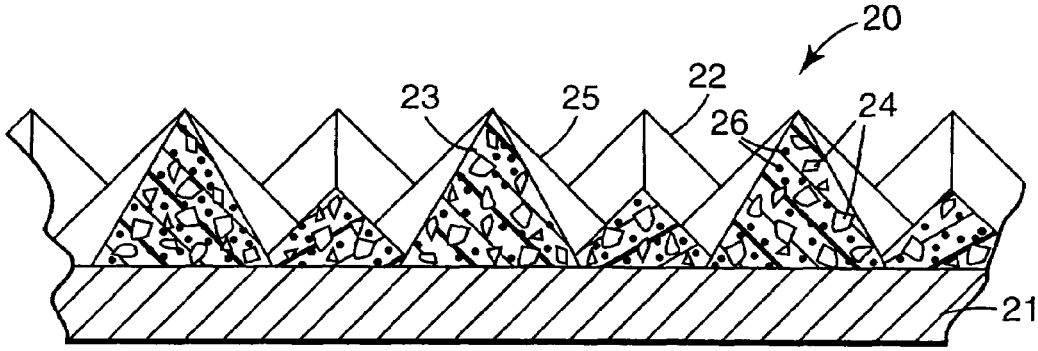
FIG. 1 is a cross-sectional view, enlarged, of an abrasive article according to the present invention having a first structured abrasive topography.

In many grinding operations, cut rate consistency and predictable finish through the life of the abrasive is desired. There are some applications, for example, off-hand degating of castings and forgings, where a continuous declining cut rate is desired, as the very aggressive initial cut accomplishes the most of the work, after which the article reaches a dulling, capping, or wear-out endpoint. However, shaft and roll grinding and similar centerless/cylindrical grinding operations exemplify cases where a "flat" cut rate and finish are a primary importance.

Agglomerate products such as 3M's "Multicut" coated abrasive and "366FA Trizact" particle coated abrasive exhibit flatter cut and finish curves than comparable conventional (i.e., single layer make/coat) abrasive articles in centerless applications. However, 3M's Multicut and conventional make/size products are lacking in performance against VSM's "Compact Grain" ("CG") agglomerate products in the intermediate and coarse grade ranges (e.g., grade 50 (average particle size approx. 500 micrometers) to grade 180 (average particle size approx. 85 micrometers). VSM's "Compact Grain" ("CG") agglomerate products, such as "KK718X Vitex", represent a benchmark value in much of the centerless grinding market segment.

Structured abrasive articles, such as those described in the Background of this application, provide highly consistent surface finishes with exceptionally long use life of the product. Currently commercially available structured abrasive products, such as those available from 3M Company of St. Paul, Minn. under the trade designation "Trizact" utilize fused aluminum oxide and silicon carbide abrasive particles having average particle sizes ranging from 3 micrometers (WA5000 grade) to approximately 125 micrometers (P120 grade). These products are directed to fine-grade finishing and polishing applications. Larger grade structured abrasives have not been available prior to the current invention, due to restrictions based on the production tooling used to manufacture the structured abrasive articles.

The abrasive articles of the current disclosure extend the concept of finish consistency and extended life to include high, sustained cut rates suitable for dimensioning, blending, and other stock-removal grinding applications typically utilizing conventional make/size abrasive articles or agglomerate abrasive articles in the coarse and intermediate-grade ranges (e.g., grade 50 (average particle size approx. 500 micrometers) to grade 180 (average particle size approx. 85 micrometers).

The abrasive articles of the current disclosure retain their cut rate over an extended period of time. Under typically grinding conditions, the large topography with large ceramic abrasive particles abrasive article will have a cut rate decrease of, usually, no greater than about 50%, over the expected life (usually at least 20 minutes) of the abrasive article. For some articles, the cut rate decrease is no greater than about 30%, and other articles, the cut rate decrease is no greater than about 15%. The amount of cut rate decrease is based on various conditions, for example, such as abrasive particle size and the grinding test being used.

In the following description of preferred embodiments, reference is made to the accompanying drawings, which form a part hereof, and in which is shown, by way of illustration, specific embodiments in which the invention may be practiced. It is to be understood that other embodiments may be utilized and formulational or structural changes may be made without departing from the scope of the present invention.

Referring to FIG. 1, an abrasive article 20 according to the present disclosure is shown. Abrasive article 20 comprises a plurality of abrasive composites 22 bonded to backing 21. Abrasive composites 22 comprise a plurality of abrasive particles 24 that are dispersed in a binder 23. Abrasive composites 22 are defined by side edges 25, which in this embodiment, are linear.

Ceramic Abrasive Particles

Abrasive composites 22 comprise large or coarse ceramic abrasive particles 24. It has been found that abrasive articles having large ceramic abrasive particles 24 in a large topography abrasive composite 22 have a higher cut rate and a longer life having a consistent cut rate throughout the life, compared to an abrasive article having large particle size abrasive agglomerates bonded to the backing with conventional make and size resin coats. By use of the term "large" when referring to abrasive particle size, what is intended are abrasive particles having an average particle size of at least 40 micrometers (approx. grade P360 or ANSI 320). By use of the term "coarse" when referring to abrasive particle size, what is intended are abrasive particles having an average particle size of at least 100 micrometers (approx. grade P180 or ANSI 150). In some embodiments, the ceramic abrasive particles have an average particle size of at least 400 micrometers (approx. grade 60).

The average particle size of the ceramic abrasive particles suitable for the abrasive articles of the present disclosure is at least 40 micrometers, usually at least 50 micrometers, and preferably at least 85 micrometers. For some abrasive articles of the present invention, the size of the ceramic abrasive particles is at least 100 micrometers. Other embodiments have the ceramic abrasive particles at least 200 micrometers, some at least 300 micrometers, and often at least 400 micrometers. Specific abrasive particle sizes (that is, average particle sizes) for some preferred abrasive articles include approximately 45, 65, 80, 100, 160, 300 micrometers, and 400 micrometers.

It is well known in the abrasives art that abrasive particles are sized according to "grade" or "mesh", which is a distribution or range of particle sizes, rather than all the particles having the same size. See for example, ANSI B74.18-1996 "For Grading of Certain Abrasive Grain on Coated Abrasive Material" for abrasive particle grading standards. As used herein, when a particle size is provided, what is meant is the average particle size of the particle distribution.

The abrasive particles used in the abrasive composites are polycrystalline ceramic abrasive particles, typically made from a sol gel process. Ceramic alpha-alumina abrasive particles can also be made from sintered alpha-alumina (aluminum oxide) powders. Ceramic abrasive particles typically have a Mohs' hardness of at least 9.

Sintered sol-gel alumina abrasive particles are generally produced by a process which includes preparing a dispersion of an alumina monohydrate to which a modifier may be added, gelling the dispersion, drying the gelled dispersion, crushing the dried gelled dispersion to form particles, calcining the particles, and firing the particles to form abrasive particles. Various adaptations and modification of this basic process have been developed and disclosed since the process was first discovered and disclosed to the art. The firing step is carried out to sinter the grains at temperatures below the fusion temperature of aluminum oxide. The sol-gel process of making alumina abrasive particles is more fully described in U.S. Pat. Nos. 4,314,827 and 4,518,397 (Leitheiser et al.). Variations on this process include adding alpha-alumina seeds or iron oxide seeds to the dispersion.

Examples of suitable, commercially available ceramic abrasive particles include "Cerpass" from Norton Company of Worchester, Mass., and "Alodur CCCPL" from Treibacher-Schleifmittel, Villach, Austria. Various products commercially available from 3M incorporate ceramic abrasive particles. One particular ceramic abrasive particle suitable for use in the abrasive articles, which is available in abrasive products available from 3M, is known under the trade designation "Cubitron 321". This ceramic abrasive particle is a non-seeded, alumina particle having additives of yttrium, neodymium, lanthanum, cobalt, and magnesium.

References which disclose various compositions and methods of making ceramic particles include: U.S. Pat. No. 4,623,364 (Cottringer et al.), which discloses using an alpha-alumina seed; U.S. Pat. No. 4,964,883 (Morris et al.), which discloses using an iron oxide seed; U.S. Pat. No. 4,881,951 (Monroe et al.), which discloses the addition of rare earth oxide materials to the sol gel; U.S. Pat. No. 5,611,829 (Monroe et al.), which discloses combining iron oxide and silica; U.S. Pat. No. 5,312,789 (Wood), which discloses impregnating additives, such as rare earth oxides, into the particles prior to sintering; and U.S. Pat. No. 5,201,916 (Berg et al.), which discloses molding of ceramic particles, all of which are incorporated herein by reference.

Abrasive Composite Size

Abrasive composites 22 of the disclosure comprise large-scale topography, or, large prismatic structures. It has been found that abrasive articles having large ceramic abrasive particles 24 in a large topography abrasive composite 22 have a more consistent cut rate and a longer life, compared to conventionally made large agglomerate products such as Multicut, VSM CG, and 366FA Trizact abrasive articles.

The maximum height of abrasive composite 22, measured from the surface of the backing on which the composite is bonded, is at least 0.02 inch (about 500 micrometers) high, usually at least 0.03 inch (about 750 micrometers) high, and, in one embodiment, at least 0.04 inch (about 1000 micrometers) high.

Abrasive composite 22 can be any shape, but it is preferably a geometric shape such as a cube, pillar, column, cone, truncated cone, semi-sphere, pyramid, truncated pyramid, and the like. Preferred shapes are three-sided and four-sided pyramids. It is generally preferred that the abrasive composite cross sectional surface area decreases away from the backing or decreases along its height. This variable surface area results in a non-uniform pressure as the abrasive composite wears during use. Additionally, during manufacture of the abrasive article, this variable surface area results in easier release of the abrasive composite from the production tool.

Figure 2:
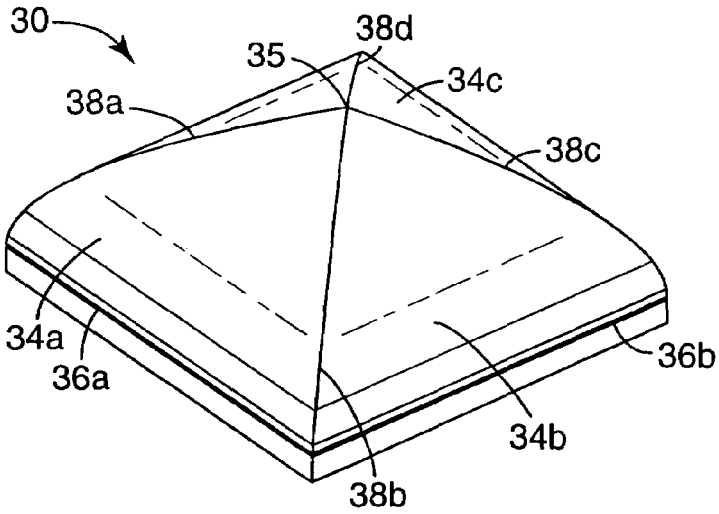
FIG. 2 is a schematic, perspective top and side view of a second structured abrasive topography.

In general there are at least 25 individual abrasive composites per square cm. In some instances, there may be at least 50 individual abrasive composites/square cm. One preferred composite is a square-based pyramid having linear side faces meeting at a peak or apex. Another preferred composite, illustrated in FIG. 2, is a modified pyramid having a four-sided base, with the geometry of the faces of the pyramid being a parabolic function. That is, the pyramid has generally curved faces, defined at least partially, by a parabola, that meet at an apex. In some designs, the parabolic function includes a square root function. In particular, abrasive composite 30 has four sides (with only three sides 34*a*, 34*b*, 34*c* being seen in FIG. 2). Sides 34*a*, 34*b*, 34*c* are defined by a base edge (with only two base edges 36*a*, 36*b* being seen) and by side edges 38*a*, 38*b*, 38*c*, 38*d* which meet at peak 35. Each of side edges 38*a*, 38*b*, 38*c*, 38*d* is defined by a parabolic function based on base edge 36*a*, 36*b*, etc. Such pyramids are described in detail in Assignee's application having attorney docket number 58725US002, filed on even date herewith. For both of these preferred composite arrays, each composite may be the same in base size to each adjacent composite, or, each composite may differ in base size from each adjacent composite. An example of varying base sizes for adjacent composites is disclosed, for example, in U.S. Pat. No. 5,672,097 (Hoopman et al.).

As stated above, abrasive composites 22, comprising the ceramic abrasive particles 24 dispersed in binder 23, are bonded to backing 21.

Backing

Backing 21 has a front and back surface and can be any conventional abrasive backing. Examples of suitable backings include polymeric film, knitted or woven cloth, paper, vulcanized fiber, nonwovens, primed versions thereof, and combinations thereof. Any of these backings can be reinforced to provide increased strength and stretch resistance. The backing may have an attachment means on its back surface to enable securing the resulting coated abrasive to a support pad or back-up pad. Examples of suitable attachment means include pressure sensitive adhesive, one surface of a hook and loop attachment system, an intermeshing attachment system, as disclosed in U.S. Pat. No. 5,201,101 (Rouser et al.), and a threaded projection, as disclosed in U.S. Pat. No. 5,316,812 (Stout et al.).

Binder

The ceramic abrasive particles are dispersed in an organic binder to form the abrasive composite. The binder is derived from a binder precursor which comprises an organic polymerizable resin. During the manufacture of the abrasive articles, the binder precursor is exposed to an energy source which aids in the initiation of the polymerization or curing process. Examples of energy sources include thermal energy and radiation energy, the latter including electron beam, ultraviolet light, and visible light. During this polymerization process, the resin is polymerized and the binder precursor is converted into a solidified binder. Upon solidification of the binder precursor, the abrasive composite is formed. The binder in the abrasive composite is also generally responsible for adhering the abrasive composite to the backing.

There are two preferred classes of resins for use in the structured abrasive articles of the present invention, condensation curable and addition polymerizable resins. The preferred binder precursors include addition polymerizable resins because these resins are readily cured by exposure to radiation energy. Addition polymerizable resins can polymerize through a cationic mechanism or through a free radical mechanism. Depending upon the energy source that is utilized and the binder precursor chemistry, a curing agent, initiator, or catalyst is sometimes preferred to help initiate the polymerization.

Examples of typical and preferred organic resins include phenolic resins (both resole and novolac), urea-formaldehyde resins, melamine formaldehyde resins, acrylated urethanes, acrylated epoxies, ethylenically unsaturated compounds, aminoplast derivatives having pendant unsaturated carbonyl groups, isocyanurate derivatives having at least one pendant acrylate group, isocyanate derivatives having at least one pendant acrylate group, vinyl ethers, epoxy resins, mixtures and combinations thereof. The term "acrylate" encompasses acrylates and methacrylates.

Acrylated urethanes are diacrylate esters of hydroxy-terminated, isocyanate NCO extended polyesters or polyethers. Examples of commercially available acrylated urethanes include those known under the trade designations "UVITHANE 782", available from Morton Thiokol Chemical, and "CMD 6600", "CMD 8400", and "CMD 8805", available from Radcure Specialties.

Acrylated epoxies are diacrylate esters of epoxy resins, such as the diacrylate esters of bisphenol A epoxy resin. Examples of commercially available acrylated epoxies include those known under the trade designations "CMD 3500", "CMD 3600", and "CMD 3700", available from Radcure Specialities.

Ethylenically unsaturated compounds include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like.

Representative examples of ethylenically unsaturated acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloyloxyethyl) isocyanurate, 1,3,5-tri(2-methylacryloxyethyl)-triazine, acrylamide, methylacrylamide, N-methylacrylamide, N,N-dimethylacrylamide, N-vinylpyrrolidone, and N-vinylpiperidone.

Aminoplast resins and their derivatives have at least one pendant alpha, beta unsaturated carbonyl group per molecule or oligomer. These unsaturated carbonyl groups can be acrylate, methacrylate, or acrylamide type groups. Examples of such materials include N-(hydroxymethyl)acrylamide, N,N'-oxydimethylenebisacrylamide, ortho and para acrylamidomethylated phenol, acrylamidomethylated phenolic novolac, and combinations thereof. These materials are further described in U.S. Pat. Nos. 4,903,440 and 5,236,472 both incorporated herein by reference.

Isocyanurate derivatives having at least one pendant acrylate group and isocyanate derivatives having at least one pendant acrylate group are described in U.S. Pat. No. 4,652,274 (Boettcher et al.), which is incorporated herein by reference. A preferred isocyanurate material for structure abrasive articles is a triacrylate of tris(hydroxy ethyl) isocyanurate.

Epoxy resins, also suitable for the structure abrasive articles of the present invention, have an oxirane and are polymerized by the ring opening. Such epoxide resins include monomeric epoxy resins and oligomeric epoxy resins. Examples of some preferred epoxy resins include 2,2-bis[4-(2,3-epoxypropoxy)-phenyl propane] (diglycidyl ether of bisphenol) and commercially available materials under the trade designations "Epon 828", "Epon 1004", and "Epon 1001F" available from Shell Chemical Co., "DER- 331", "DER-332", and "DER-334" available from Dow Chemical Co. Other suitable epoxy resins include glycidyl ethers of phenol formaldehyde novolac (e.g., "DEN-431" and "DEN-428" available from Dow Chemical Co.). For epoxy resins, an appropriate cationic curing agent can be added to polymerize the epoxide via a cationic mechanism; cationic curing agents generate an acid source to initiate the polymerization of an epoxy resin.

For free radical curable resins, it is often preferred that the abrasive slurry further includes a free radical curing agent. In the case of an electron beam energy source, however, the curing agent is less needed because the electron beam itself generates free radicals. Examples of free radical thermal initiators include peroxides, e.g., benzoyl peroxide, azo compounds, benzophenones, and quinones. When used with either ultraviolet or visible light energy sources, these curing agents are often referred to as photoinitiators. Examples of initiators, that when exposed to ultraviolet light generate a free radical source, include organic peroxides, azo compounds, quinones, benzophenones, nitroso compounds, acryl halides, hydrozones, mercapto compounds, pyrylium compounds, triacrylimdazoles, bisimidazoles, chloroalkytriazines, benzoin ethers, benzil ketals, thioxanthones, acetophenone derivatives, and mixtures thereof. Examples of initiators, that when exposed to visible radiation generate a free radical source, can be found in U.S. Pat. No. 4,735,632 (Boettcher et al.), which is incorporated herein by reference. The preferred initiator for use with visible light is "Irgacure 369" commercially available from Ciba Geigy Corporation.

The level of binder, and other organic materials (such as any initiator, coupling agents, etc.) in the cured abrasive composite is usually about 10-50 wt-% of the total composite. In some embodiments, the level of these organic constituents is about 15-40 wt-%.

Optional Additives

As described above, abrasive composites 22 comprise ceramic abrasive particles 24 dispersed in binder 23. Composites 22 may include other additives to modify the properties of composites 22.

Abrasive composite 22 may include diluent particles or other filler particles to modify the performance of the abrasive composite. The particle size of these optional particles may be on the same order of magnitude as the ceramic abrasive particles, but typically will be smaller. Examples of suitable particles include gypsum, marble, limestone, flint, silica, glass bubbles, glass beads, aluminum silicate, and the like.

Secondary abrasive particles may be present together with the large ceramic abrasive particles. Preferably, any secondary abrasive particles have a smaller average particle size that the large, ceramic abrasive particles. Examples of usable abrasive particles include fused aluminum oxide (which includes brown aluminum oxide, heat treated aluminum oxide and white aluminum oxide), green silicon carbide, silicon carbide, chromia, alumina zirconia, diamond, iron oxide, ceria, cubic boron nitride, boron carbide, gamet, and combinations thereof. Ceramic aluminum oxide particles could also be used.

The large ceramic abrasive particles, filler particles or secondary abrasive particles may have a surface coating or treatment thereon. The surface coating may have many different functions. In some instances the surface coating increases adhesion of abrasive particles or other particles to the binder, alter the abrading characteristics of the abrasive particle, and the like. Examples of surface coatings include coupling agents, halide salts, metal oxides including silica, refractory metal nitrides, refractory metal carbides and the like.

A grinding aid may be present within the abrasive composite. Grinding aids encompass a wide variety of different materials and can be inorganic or organic based. Examples of chemical groups of grinding aids include waxes, organic halide compounds, halide salts and metals and their alloys. Examples of chlorinated waxes include tetrachloronaphtalene, pentachloronaphthalene; and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include, tin, lead, bismuth, cobalt, antimony, cadmium, iron titanium, other miscellaneous grinding aids include sulfur, organic sulfur compounds, graphite and metallic sulfides. These examples of grinding aids are meant to be representative only. One preferred grinding aid for use in structured abrasive articles is cryolite, and another is potassium tetrafluoroborate ($KBF_4$).

The abrasive composites may additionally or alternately include further optional additives, such as, for example, lubricants, wetting agents, thixotropic materials, surfactants, pigments, dyes, antistatic agents, plasticizers, and suspending agents. The amounts of these materials, and all materials, are selected to provide the properties desired.

Methods of Making Abrasive Articles

Figure 3:
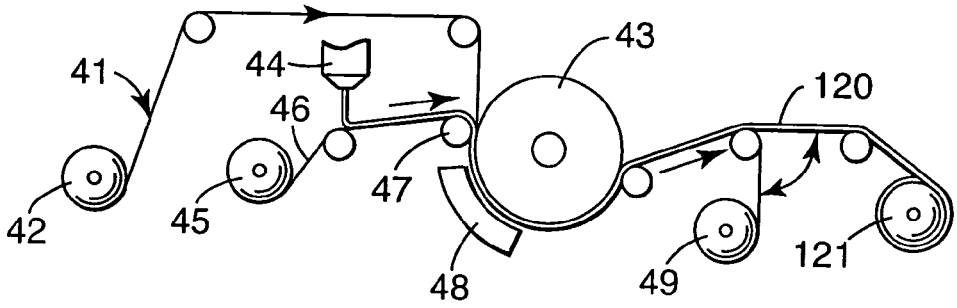
FIG. 3 is a schematic diagram of a process for making the abrasive article of FIGS. 1 and 2.

One method to make the abrasive article of the invention is schematically illustrated in FIG. 3; this method can generally be referred to as a "belt" or "web" process, referring to the production tool that is used to provide the structured surface.

Production tool 46 is an extended length having a plurality of cavities on one surface, leaves an unwind station 45. Abrasive slurry is coated onto production tool 46 and into the cavities at a coating station 44. Coating station 44 can utilize a conventional coating technique, such as a drop die coater, a knife coater, a curtain coater, a vacuum die coater or a die coater. The slurry may be heated and/or subjected to ultrasonic energy or undergo other processing prior to coating in order to lower the viscosity of the slurry. Preferably, the presence of air bubbles in the slurry is minimal. In some embodiments, the preferred coating technique is to use a vacuum fluid bearing die.

The coated production tool 46 is brought into contact with backing 41, which is from an unwind station 42. Backing 41 and the slurry are brought into contact such that the slurry wets the front surface of backing 41. In FIG. 3, a contact nip roll 47 is used to facilitate the contact, and contact nip roll 47 also forces the resulting construction against a support drum 43.

A source of energy 48 (preferably a source of visible light) transmits a sufficient amount of energy into the slurry to at least partially cure the binder precursor. This energy may be transmitted through the backing or through the tooling. The term "partial cure" is meant that the binder precursor is polymerized to such a state that the slurry does not flow from an inverted test tube. The binder precursor can be further cured once it is removed from the production tool.

After coating, production tool 46 is rewound on mandrel 49 so that production tool 46 can be reused. The resulting abrasive article 120 is wound on mandrel 121. If the binder precursor is not fully cured, the binder precursor can be fully cured, for example, by exposure to an energy source. Additional details and variations to make abrasive articles according to this first method are described in U.S. Pat. No. 5,152,917 (Pieper et al.) and U.S. Pat. No. 5,435,816 (Spurgeon et al.), both incorporated herein by reference.

Although the above-described method includes at least partially curing the binder while the abrasive slurry is in the cavities of the tool, it is understood that all the curing could be done after removal of the production tool.

In an alternate method, the abrasive slurry can be coated directly onto backing 41 rather than into the cavities of production tool 46. The slurry coated backing is then brought into contact with production tool 46 such that the slurry flows into the cavities of production tool 46. The remaining steps to make the abrasive article are the same as detailed above.

Figure 4:
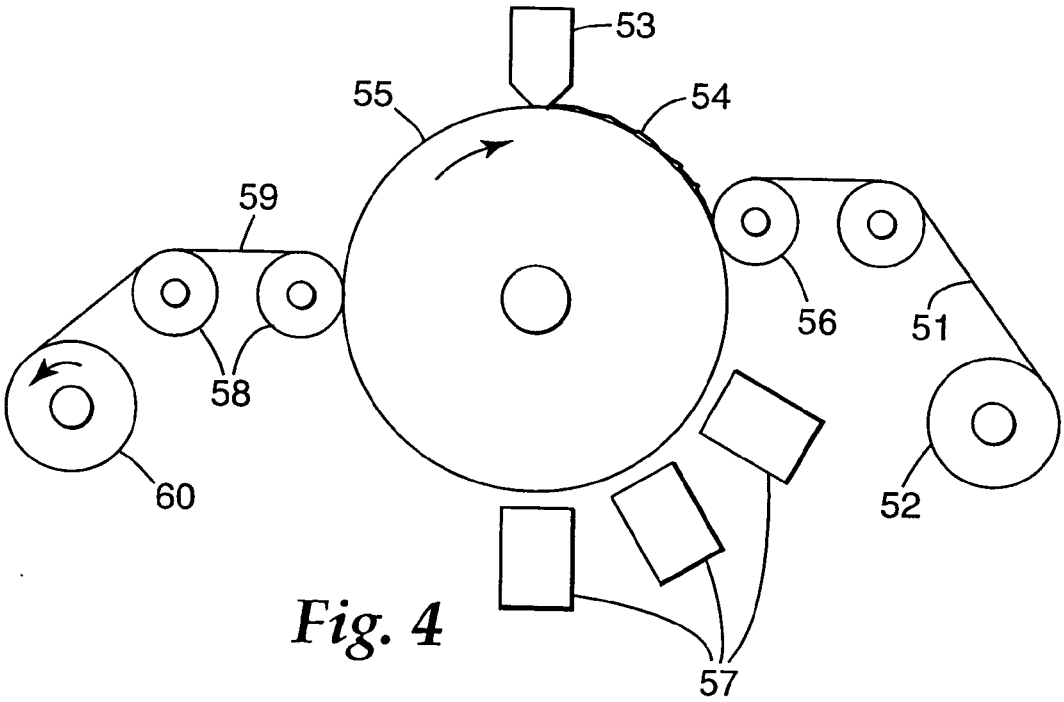
FIG. 4 is a schematic diagram of another process for making the abrasive article of FIGS. 1 and 2.

Another method for making a structured abrasive article is illustrated in FIG. 4; this method can generally be referred to as a "drum" method, referring to the production tool used to generate the structured surface.

An abrasive slurry 54 is coated into the cavities of a production tool 55 at coating station 53. Slurry 54 can be coated onto tool 55 by any suitable technique, such as drop die coating, roll coating, knife coating, curtain coating, vacuum die coating, or die coating. Again, it is possible to process the slurry prior to coating to lower the viscosity and/or minimize bubbles.

Backing 51, from an unwind station 52, is brought into contact with production tool 55 containing the abrasive slurry by a nip roll 56 such that the slurry wets the front surface of backing 51. Next, the binder precursor in the slurry is at least partially cured by exposure to an energy source 57. The resulting abrasive article 59 is removed from production tool 55 by nip rolls 58 and wound onto a rewind station 60.

Although the above-described method includes at least partially curing the binder while the abrasive slurry is in the cavities of the tool, it is understood that all the curing could be done after removal of the backing 51 and slurry 54 from the production tool 55.

In an alternate method, the abrasive slurry can be coated directly onto backing 51 rather than into the cavities of production tool 55. The slurry coated backing is then brought into contact with production tool 55 such that the slurry flows into the cavities of production tool 55. The remaining steps to make the abrasive article are the same as detailed above.

It is preferred that the binder precursor is cured by radiation energy. The radiation energy can be transmitted through the production tool so long as the production tool does not appreciably absorb the radiation energy. Additionally, the radiation energy source should not appreciably degrade the production tool. It is preferred to use a thermoplastic production tool and ultraviolet or visible light.

EXAMPLES

The following non-limiting examples will further illustrate the invention. All parts, percentages, ratios, etc., in the examples are by weight unless otherwise indicated. The following abbreviations listed in Table 1 are used throughout the Examples.

TABLE 1

| | |
|---|---|
| TMPTA | trimethylol propane triacrylate; commercially available from Sartomer Co. under the trade designation "SR351" |
| TATHEIC | triacrylate of tris(hydroxy ethyl)isocyanurate; commercially available from Sartomer Co. under the trade designation "SR368" |
| PH2 | 2-benzyl-2-N,N-dimethylamino-1-(4-morpholinophenyl)-1-butanone, commercially available from Ciba Geigy Corp. under the trade designation "Irgacure 369" |
| ASF | amorphous silica filler, commercially available from DeGussa under the trade designation "OX-50" |
| 60 CAO | ceramic aluminum oxide, grade 60 (approx. 400 micrometers average particle size) according to the teachings of U.S. Pat. No. 5,312,789 |
| 80 CAO | ceramic aluminum oxide, grade 80 (approx. 300 micrometers average particle size) according to the teachings of U.S. Pat. No. 5,312,789 |
| 180 CAO | ceramic aluminum oxide, grade 180 (approx. 100-110 micrometers average particle size) according to the teachings of U.S. Pat. No. 5,312,789 |
| JIS400 CAO | ceramic aluminum oxide, grade JIS 400 (approx. 35 micrometers average particle size) according to the teachings of U.S. Pat. No. 5,312,789 |
| 80 FAO | fused heat treated aluminum oxide, grade 80 (approx. 200 micrometers average particle size) commercially available from Triebacher, Villach, Austria |
| F360 FAO | wheel grade F360 fused heat treated aluminum oxide, (approx. 40 micrometer average particle size) commercially available from Triebacher |
| P600 FAO | fused heat treated aluminum oxide, FEPA grade P600 (approx. 35 micrometer average particle size) commercially available from Triebacher |
| 60 NCAO | ceramic aluminum oxide, grade 60, commercially available from Saint Gobain Ceramic Materials under the trade designation "Cerpass-XLT" |
| SCA | silane coupling agent, 3-methacryloxypropyltrimethoxysilane, commercially available from Crompton Corp. under the trade designation "A-174NT" |
| KBF4 | 98% pure micropulverized potassium tetrafluoroborate ($KBF_4$), in which at least 95% by weight passes through a 325 mesh screen and a 100% by weight passes through a 200 mesh screen |
| FGP | alumino-boro-slilicate glass frit powder, −325 mesh, commercially available from Ferro Corporation, Cleveland, OH under the trade designation "3226-3" |
| KB1 | photoinitiator, 2,2-dimethoxy-1,2-diphenylethaneone, commercially available from Lamberti S.P.A. to Sartomer Co., under the trade designation "ESACURE KB 1" |

TABLE 1-continued

| | |
|---|---|
| PRO | 59.41/39.6/0.99 mixture of TMPTA/TATHEIC/KB1, commercially available from Sartomer Co., under the trade designation "Pro 1555" |
| CaSi | surface-modified calcium metasilicate filler, commercially available from NYCO, Willsboro NY under the trade designation "Wollastocoat M400" |

General Procedure 1 for Making Abrasive Articles

An abrasive slurry was prepared by mixing the abrasive particles, binder precursor and other materials listed in Table 2, below. The slurry was mixed for about 10 minutes at about 1200 rpm using a high shear mixer.

TABLE 2

| Example | TMPTA | PH2 | KBF4 | PRO | CaSi | ASF | FGP | SCA | Mineral |
|---|---|---|---|---|---|---|---|---|---|
| 1 | 1658 | 16.5 | 1368 | | | | 1368 | 27 | 4109 |
| 2 | 1658 | 16.5 | 1368 | | | | 1368 | 38 | 4109 |
| 3 | 1168 | 11.6 | 964 | | | | 964 | 19 | 2894 |
| 4 | 1168 | 11.6 | 964 | | | | 964 | 19 | 2894 |
| 5 | | 8 | | 772 | 400 | 14 | 400 | 30 | 1201 |
| 6 | | 8 | | 772 | 400 | 14 | 400 | 30 | 1201 |
| 7 | 612 | 6.2 | | | 600 | 14 | | 30 | 1201 |
| 8 | 612 | 6.2 | | | 600 | 14 | | 30 | 1201 |
| 9 | 612 | 6.2 | | | 800 | 14 | | 30 | 1201 |
| 10 | 612 | 6.2 | | | 800 | 30 | | 30 | 1300 |
| 11 | 612 | 6.2 | | | 800 | 30 | | 30 | 1300 |
| 12 | 612 | 6.2 | | | 800 | 14 | | 30 | 1201 |
| 13 | 772 | 8 | | | 700 | 14 | | 30 | 950 |
| 14 | 772 | 8 | | | 700 | 14 | | 30 | 950 |
| 15 | 772 | 8 | | | 700 | 14 | | 30 | 950 |
| 16 | 612 | 6.2 | | | 1000 | 16 | | 30 | 1201 |
| 17 | 612 | 6.2 | | | 1200 | 16 | | 30 | 1201 |

The backing for the abrasive articles was an X-weight polyester backing having a latex/phenolic resin presize treatment (85 parts/15 parts based upon a cured resin) on the front side of the backing. The presize was applied to the backing and then heated to substantially remove any volatiles and to gel the phenolic resin.

The production tool was transparent polypropylene tooling that had been embossed off a cut knurl nickel-plated master tool. The polypropylene tool had a plurality of cavities defined by a rectangular-based (including square-based) pyramidal type pattern. The pyramid features were placed such that their bases were butted up against one another. The feature profile characteristics and nominal dimensions of the pyramid tooling feature types were as described in Table 3.

TABLE 3

| Tooling type | Pyramid base geometry | Pyramid base width inch (μm) | Average pyramid base width inch (μm) | Pyramid height inch (μm) | Pyramid edge profile |
|---|---|---|---|---|---|
| CK #7 | Square | 0.06 (1524) | 0.06 (1524) | 0.024 (610) | linear |
| 025 SQRT | Rectangular | 0.03-0.065 (762-1593) | 0.05 (1270) | 0.025 (635) | square root |
| 030 SQRT | Rectangular | 0.045-0.09 (1103-2205) | 0.65 (1651) | 0.03 (762) | square root |
| 040 SQRT | Rectangular | 0.065-0.12 (1593-2940) | 0.85 (2159) | 0.04 (1016) | square root |

The abrasive articles of Examples 1-15 were made on an apparatus similar to that illustrated in FIG. 3, using an endless belt of production tool. The process operated at approximately 15 meters/minute (50 ft/min). The abrasive slurry was knife coated about 18 cm wide onto the front side of the backing. The knife gap was set to be approximately 457-635 micrometers (18-25 mils). The slurry-coated backing was brought into contact with the cavities of the production tool under pressure of a nip roll, and the slurry was then irradiated with visible light from two visible lamps ("D" bulbs, commercially available from Fusion Corp.) operating at 600 Watts/inch. The nip pressure between the production tool and the backing was about 60 pounds (27 kg). After the abrasive article was removed from the apparatus FIG. 3, it was heated for 24 hours at 115° C. to fully cure, as needed, the composites and the backing treatment. The abrasive article was not flexed prior to testing.

General Procedure 2 for Making Abrasive Articles

The abrasive articles of Examples 16-17 were formed by hand-spreading the slurry mixture onto the front side of the backing, sprinkling CaSi powder over the surface, pressing the tooling into the slurry, removing the formed, uncured abrasive material, and curing the samples outside of the tool with visible light at 7.5 meters/minute (25 ft/min) using one 600 Watt "D" bulb.

Table 4 summarizes the abrasive particles used for Examples 1-17 and the tooling used to form the composites.

TABLE 4

| Example | Mineral grade and type | Approx. mineral size μm | Tooling feature type | Composite Height inch (μm) |
|---|---|---|---|---|
| 1 | 80 CAO | 300 | 025 SQRT | 0.025 (635) |
| 2 | 60 CAO | 400 | 030 SQRT | 0.03 (762) |
| 3 | 80 CAO | 300 | #7 CK | 0.024 (610) |
| 4 | 80 FAO | 300 | #7 CK | 0.024 (610) |
| 5 | 180 CAO | 100-110 | 030 SQRT | 0.03 (762) |
| 6 | 180 CAO | 100-110 | 040 SQRT | 0.04 (1016) |
| 7 | 180 CAO | 100-110 | 030 SQRT | 0.03 (762) |
| 8 | 180 CAO | 100-110 | 040 SQRT | 0.04 (1016) |
| 9 | 80 CAO | 300 | 030 SQRT | 0.03 (762) |

TABLE 4-continued

| Example | Mineral grade and type | Approx. mineral size μm | Tooling feature type | Composite Height inch (μm) |
|---|---|---|---|---|
| 10 | 80 CAO | 300 | 040 SQRT | 0.04 (1016) |
| 11 | 80 FAO | 300 | 040 SQRT | 0.04 (1016) |
| 12 | 60 CAO | 400 | 040 SQRT | 0.04 (1016) |
| 13 | F360 FAO | 40 | 030 SQRT | 0.03 (762) |
| 14 | P600 FAO | 30 | 030 SQRT | 0.03 (762) |
| 15 | JIS400 CAO | 30 | 030 SQRT | 0.03 (762) |
| 16 | 60 NCAO | | 040 SQRT | 0.04 (1016) |
| 17 | 60 NCAO | | 040 SQRT | 0.04 (1016) |

The abrasive articles, made as described above, were tested according to the following descriptions of Test Procedures I through III. Also tested were numerous commercially available abrasive articles, listed in Table 8. The results of the testing are provided in Table 9.

Test Procedure I

The abrasive article was formed into an endless belt 7.6 cm×335 cm (3 in×132 in). The belt was installed on a Standard Tool Backstand grinder using the conditions described in Table 5. The workpieces were held by hand in a horizontal position and the thin edge of the workpiece was pressed against the contact wheel with a force of approximately 120 N (28 lb), as measured with a hand-held force gauge (Shimpo FGV-50). The workpiece was traversed one time across the face of the contact wheel at a rate of 5 cm/sec (2 in/sec) to accomplish one test cycle. The average amount of stock removed from each of the first 16 workpieces was recorded as the initial cut (g/cycle), and the average amount of stock removed from each of the last 16 workpieces was recorded as the final cut (g/cycle). The cumulative total amount of stock removed throughout the duration of the test (80 or 240 cycles) was recorded as the total cut (g). The workpiece was held so that the horizontal face of the workpiece was generally parallel to the rotation axis of the contact wheel, and the line of contact with the abrasive belt was at a location approximately 25 cm (1 in) below the axis of the contact wheel.

TABLE 5

| | |
|---|---|
| Abrasive Belt Size | 7.6 cm × 335 cm (3 in × 132 in) |
| Machine | Standard Tool Backstand Lathe grinder (5 hp model), Standard Electric Tol Co., Cincinnati, OH |
| Abrasive Speed | 2122 surface m/min (6963 surface ft/min) |
| Contact Wheel | 35.3 cm (14 in) diameter, 85A durometer, serrated 1:1 |
| Workpiece | 304 stainless steel sheets ~15.2 cm × 30.5 cm × ~0.3 cm (~6 in × 12 in × ~0.120 in) |
| Grinding Pressure | ~120 N (~28 lb) hand pressure |
| Feed Rate | 5 cm/sec (2 in/sec) |
| Coolant | none |

Test Procedure II

The abrasive article was formed into an endless belt 30 cm×244 cm (12 in×96 in). The belt was installed on the ACME Flat-Head Finisher using the conditions described below in Table 6. The effective cutting area of the belt was 15 cm×244 cm and the ground surface of the workpieces measured 15 cm×1.2 m. The workpieces were fed continuously into the machine on a conveyor belt running at 10.7 m/min. The test was run until 1200 feet (366 m) of workpiece sheets were ground, and the contact wheel of the machine was adjusted downward throughout the test to maintain a constant pressure on the workpieces. Grinding pressure was monitored by the amp draw of the belt drive motor above a no-load condition. The cumulative amount of stock removed from the first 5 workpiece sheets (100 ft (30.5 m) or one cycle) was recorded as the initial cut (g/cycle), and the amount of stock removed from the last 5 workpiece sheets was recorded as the final cut (g/cycle). The total amount of stock removed during the test (1200 ft (366 m)) was recorded as the total cut.

TABLE 6

| | |
|---|---|
| Abrasive Belt Size | 30 cm × 244 cm (12 in × 96 in) |
| Machine | 30 cm (12 in) ACME Flat-Head Finisher, ACME Manufacturing Co., Detroit, MI |
| Abrasive Speed | 1372 surface m/min (4500 surface ft/min) |
| Conveyor Speed | 10.7 m/min (35 ft/min) |
| Contact Wheel | 20 cm (8 in) diameter, 70A durometer, serrated 1:1 |
| Grinding Pressure | 1.3 amp/cm (3.3 amp/inch) |
| Workpiece | 304 stainless steel sheets 15.2 cm × 1.2 m × ~0.3 cm (6 in × 48 in × ~0.120 in) |
| Coolant | Chemtool CT 2552 (8% concentration) |

Test Procedure III

The abrasive article was formed into an endless belt 10 cm×137 cm (4 in×54 in). The belt was installed on the ACME Centerless grinder using the conditions described below in Table 7. Workpieces were either 1045 carbon steel or 304 stainless steel round bars 3.2 cm dia.×91 cm long (1.250 in×36 in). Each workpiece was passed through the ACME machine 5 cycles under a flood of coolant directed at the belt-workpiece interface. The throughput direction for the bar was reversed for each cycle. The average amount of stock removed in the first 5 cycles of a test was recorded as the initial cut (g/cycle). The average amount of stock removed in the last 5 cycles of a test was recorded as the final cut (g/cycle). The regulating wheel of the ACME Centerless grinder was adjusted manually to maintain constant pressure on the workpiece throughout each grinding cycle. Grinding pressure was monitored by the amp draw of the belt drive motor above a no-load condition. Test duration was 30, 60, 65, or 80 cycles, as indicated. Tests for any Example were terminated when the cut rate dropped to at least 60% of the initial cut recorded for that Example. The cumulative total amount of stock removed through the duration of a test was recorded as the total cut (g).

TABLE 7

| | |
|---|---|
| Abrasive Belt Size | 10 cm × 137 cm (4 in × 54 in) |
| Machine | ACME Model 47 Centerless grinder, ACME Manufacturing Co., Detroit, MI |
| Abrasive Speed | 1219 surface m/min (4000 surface ft/min) |
| Regulating Wheel Speed | 50 rpm |
| Through-feed Rate | 3.05 m/min (10 ft/min) |
| Contact Wheel | 20 cm (8 in) diameter, 70A durometer, smooth face |
| Grinding Pressure | 0.148 amp/cm (0.375 amp/inch) |
| Workpiece | 1045 carbon steel or 304 stainless steel round bar 3.2 cm dia. × 91 cm (1.250 in. × 36 in) |
| Coolant | Chemtool CT 2552 (5% concentration) |

Measurement of Surface Finish

The surface finish (Ra) of workpieces tested according to Test Procedure 3 was measured at the end of every fifth grinding cycle. Ra is the arithmetic average of the scratch depth expressed in micrometers (um). Ra was measured using a Mahr Perthometer profilometer (Model M4P, available from Mahr Corporation, Cincinnati, Ohio).

TABLE 8

| Comparative Example | Description |
|---|---|
| A | "979F Multicut C" from 3M Company, St. Paul, MN (conventional coated abrasive with make and size coats and gravity deposited ceramic aluminum oxide abrasive particle agglomerates; ANSI grade 80 (approx. 190 micrometer average particle size)) |
| B | "777F", from 3M Company (conventional coated abrasive with make and size coats and electrostatically deposited ceramic and fused aluminum oxide abrasive particles; ANSI grade 60 (approx. 400 micrometer average particle size)) |
| C | "R824 NorzonPlus", from Norton Company, Worcester, MA (conventional coated abrasive with make and size coats and electrostatically deposited fused aluminum oxide abrasive particles; ANSI grade 50 (approx. 510 micrometer average particle size)) |
| D | "A100 366FA TRIZACT" from 3M Company (structured abrasive article with approx. 100 micrometer average particle size gravity deposited fused aluminum oxide particle agglomerates) |
| E | "369F Multicut A" from 3M Company (conventional coated abrasive with make and size coats and gravity deposited fused aluminum oxide abrasive particle agglomerates; FEPA grade P180 (approx. 85 micrometer average particle size)) |
| F | "KK718X Vitex", from VSM Abrasives, O'Fallon, MO (conventional coated abrasive with make and size coats and electrostatically deposited fused aluminum oxide abrasive particles; FEPA grade P180 (approx. 85 micrometer average particle size)) |
| G | "KK718X Vitex", from VSM Abrasives (conventional coated abrasive with make and size coats and electrostatically deposited fused aluminum oxide abrasive particles; FEPA grade P120 (approx. 125 micrometer average particle size)) |
| H | "977F" from 3M Company (conventional coated abrasive with make and size coats and electrostatically deposited ceramic aluminum oxide abrasive particles; ANSI grade 120 (approx. 115 micrometer average particle size)) |
| I | "777F" from 3M Company (conventional coated abrasive with make and size coats and electrostatically deposited ceramic and fused aluminum oxide abrasive particles; FEPA grade P120 (approx. 125 micrometer average particle size)) |
| J | "964F" from 3M Company (conventional coated abrasive with make and size coats and electrostatically deposited ceramic aluminum oxide abrasive particles; FEPA grade P120 (approx. 125 micrometer average particle size)) |
| K | "369F Multicut A" from 3M Company (conventional coated abrasive with make and size coats and gravity deposited fused aluminum oxide abrasive particle agglomerates; FEPA grade P120 (approx. 125 micrometer average particle size)) |
| L | "KK718X Vitex", from VSM Abrasives (conventional coated abrasive with make and size coats and gravity deposited fused aluminum oxide abrasive particle agglomerates; FEPA grade P80 (approx. 200 micrometer average particle size)) |
| M | "KK718X Vitex", from VSM Abrasives (conventional coated abrasive with make and size coats and gravity deposited fused aluminum oxide abrasive particle agglomerates; FEPA grade P60 (approx. 400 micrometer average particle size)) |
| N | "KK718X Vitex", from VSM Abrasives (conventional coated abrasive with make and size coats and gravity deposited fused aluminum oxide abrasive particle agglomerates; FEPA grade P320 (approx. 50 micrometer average particle size)) |

TABLE 9

| Example | Initial cut, g/cycle | Final cut, g/cycle | Δ%, initial v. final | Initial Ra, μin | Final Ra, μin | Total Cycles | Total cut, g |
|---|---|---|---|---|---|---|---|
| 1 | 2.75 | 2.56 | 6.9 | | | 80 | 213 |
| 2 | 2.94 | 2.56 | 12.9 | | | 240 | 650 |
| Comp. A | 3.06 | 1.12 | 63.4 | | | 80 | 153 |
| Comp. B | 5.00 | 1.38 | 72.4 | | | 240 | 596 |
| 3 | 429 | 228 | 46.8 | | | 12 | 3680 |
| 4 | 303 | 176 | 41.9 | | | 12 | 2653 |
| Comp. C | 429 | 126 | 70.6 | | | 12 | 2596 |
| 5 | 54.4 | 45.6 | 16.2 | 74 | 41 | 65 | 2927 |
| 6 | 57.6 | 42.2 | 26.7 | 82 | 51 | 80 | 4433 |
| Comp. D | 35.8 | 16.8 | 53.1 | 47 | 21 | 60 | 1441 |

TABLE 9-continued

| Example | Initial cut, g/cycle | Final cut, g/cycle | Δ%, initial v. final | Initial Ra, μin | Final Ra, μin | Total Cycles | Total cut, g |
|---|---|---|---|---|---|---|---|
| Comp. E | 53.6 | 11.4 | 78.3 | 76 | 31 | 30 | 1131 |
| Comp. F | 33.8 | 8.8 | 74.0 | 47 | 16 | 45 | 1140 |
| Comp. G | 58.0 | 20.6 | 64.5 | 83 | 41 | 65 | 2927 |
| 7 | 38.2 | 30.3 | 21 | 57 | 47 | 30 | 1030 |
| 8 | 40.1 | 30.8 | 23 | 79 | 63 | 30 | 1084 |
| Comp. H | 53.4 | 22.2 | 58 | 81 | 38 | 20 | 674 |
| Comp. I | 51.6 | 18.2 | 65 | 92 | 34 | 20 | 609 |
| Comp. J | 32.8 | 9.2 | 72 | 39 | 16 | 15 | 272 |
| Comp. K | 48.8 | 19.4 | 60 | 66 | 45 | 30 | 1027 |
| 9 | 92.4 | 84.0 | 9.1 | 176 | 130 | 60 | 5449 |

TABLE 9-continued

| Example | Initial cut, g/cycle | Final cut, g/cycle | Δ%, initial v. final | Initial Ra, μin | Final Ra, μin | Total Cycles | Total cut, g |
|---|---|---|---|---|---|---|---|
| 10 | 93.6 | 82.0 | 12.4 | 168 | 111 | 60 | 5380 |
| 11 | 73.0 | 54.4 | 25.5 | 100 | 74 | 60 | 3720 |
| 12 | 112.0 | 97.2 | 13.2 | 214 | 159 | 60 | 6232 |
| Comp. L | 69.0 | 46.4 | 32.8 | 138 | 88 | 60 | 3326 |
| Comp. M | 79.6 | 44.4 | 44.2 | 164 | 90 | 60 | 3415 |
| 13 | 16.8 | 5.6 | 66.7 | 16 | 7 | 35 | 399 |
| 14 | 17.2 | 5.0 | 70.9 | 15 | 7 | 35 | 392 |
| 15 | 23.8 | 11.2 | 52.9 | 28 | 12 | 35 | 641 |
| Comp. N | 14.6 | 4.4 | 69.9 | 20 | 9 | 35 | 296 |

Examples 1-2 and Comparative Examples A-B

Examples 1-2 and Comparative Examples A-B were tested according to Test Procedure I. The test results in Table 9 show the improved consistency of cut and improved life of the abrasive articles having large topography and large ceramic particles when compared to conventional coated abrasive articles and conventional agglomerate coated abrasive articles in a simulated dry, offhand grinding application on stainless steel workpieces.

Examples 3-4 and Comparative Example C

Examples 3-4 and Comparative Example C were tested according to Test Procedure II using 304 stainless steel workpieces. The test results in Table 9 show improved cut rate, improved consistency of cut, and extended life of the abrasive article having large topography and large ceramic particles (Example 3) when compared to the example having large topography but non-ceramic abrasive particles (Example 4) and when compared to conventional coated abrasive articles in a simulated wet flat-stock grinding application.

Examples 5-6 and Comparative Examples D-G

Examples 5-6 and Comparative Examples D-G were tested according to Test Procedure III using 1045 mild steel workpieces. The test results in Table 9 show improved cut consistency, improved finish consistency, and extended life of the abrasive articles having large topography and large ceramic particles compared to conventional agglomerate coated abrasive articles on a simulated wet centerless grinding application.

Examples 7-8 and Comparative Examples H-K

Examples 7-8 and Comparative Examples H-K were tested according to Test Procedure III using 304 stainless steel workpieces. The test results in Table 9 show improved cut consistency, improved finish consistency, and extended life of the abrasive articles having large topography and large ceramic particles when compared to conventional coated abrasive articles and when compared to conventional agglomerate coated abrasive articles on a simulated wet centerless grinding application.

Examples 9-11 and Comparative Example L

Examples 9-11 and Comparative Example L were tested according to Test Procedure III using 1045 mild steel workpieces. The test results in Table 9 show improved cut consistency, improved finish consistency, and extended life of the abrasive article having large topography and large ceramic particles when compared to a conventional agglomerate abrasive article. Results for Examples 10 and 11 show improved cut rate, improved cut consistency, and extended life of the inventive abrasive article (Example 10), when compared to the example having large topography but containing non-ceramic abrasive particles (Example 11).

Example 12 and Comparative Example M

Example 12 and Comparative Example M were tested according to Test Procedure m using 1045 mild steel workpieces. The test results in Table 9 show improved cut consistency, improved finish consistency, and extended life for the abrasive article having large topography and large ceramic particles when compared to a conventional agglomerate abrasive article on a simulated wet centerless grinding application.

Examples 13-15 and Comparative Example N

Examples 13-15 and Comparative Example N were tested according to Test Procedure III using 1045 mild steel workpieces. The test results in Table 9 show improved cut consistency and extended life for the abrasive article having large topography and large ceramic abrasive particles (Example 15) when compared to a conventional agglomerate abrasive article on a simulated wet centerless grinding application. Results for Examples 13-15 show improved cut rate, improved cut consistency, and extended life of the abrasive article having large topography and large ceramic abrasive particles (Example 15) when compared to the examples having large topography but containing non-ceramic abrasive particles (Examples 13-14) on a simulated wet centerless grinding application.

Examples 16-17

Figure 5:
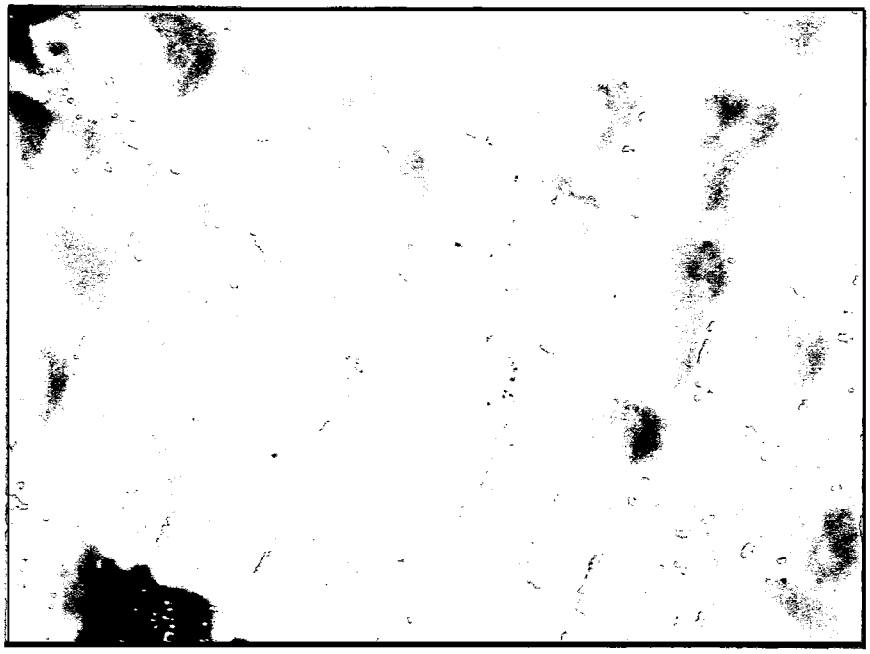
FIG. 5 is a photomicrograph of the abrasive article of Example 16.
Figure 6:
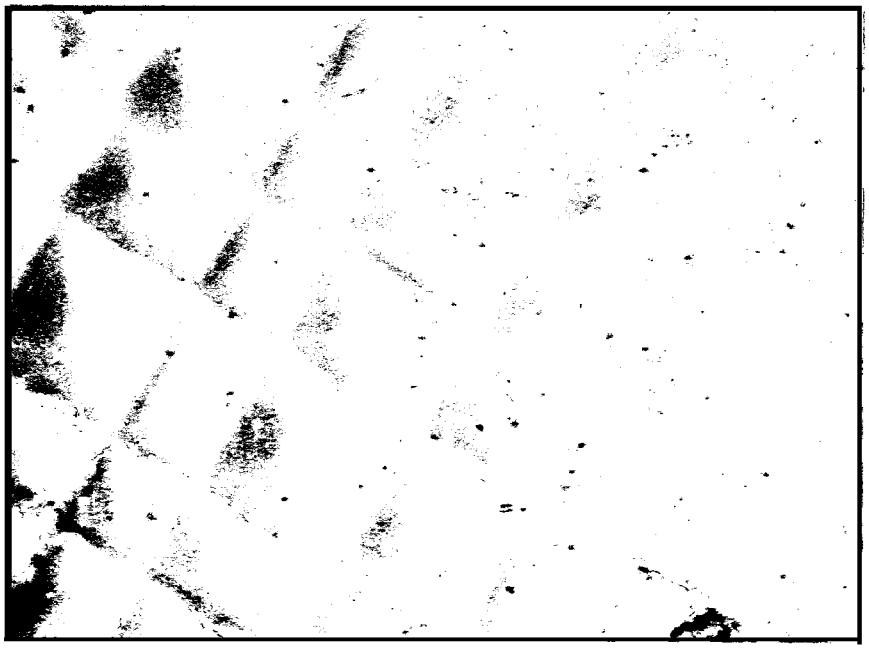
FIG. 6 is a photomicrograph of the abrasive article of Example 17.

Photomicrographs of Examples 16 and 17 are shown in FIGS. 5 and 6. These photomicrographs show large topography abrasive composites made by curing outside of the production tooling.

The above specification, examples and data provide a complete description of the manufacture and use of the abrasive article of the disclosure. Since many embodiments can be made without departing from the spirit and scope of the disclosure and the invention, the invention resides in the claims hereinafter appended.

What is claimed is:

1. A structured abrasive article comprising:

(a) a backing having a front face;

(b) a plurality of abrasive composites on the front face, each of the abrasive composites comprising:

(i) a plurality of ceramic aluminum oxide abrasive particles having an average particle size of about 300-400 micrometers;

(ii) an organic constituent comprising radiation curable binder, the organic constituent occupying 15-40 wt-% of the abrasive composite; the composites having a height, measured from the front face of the backing, 635-1016 micrometers; and (iii) faces that are defined at least partially by a parabolic function;

wherein the abrasive article produces a first cut rate and a first surface finish at a first time and a second cut rate and a second surface finish at a second time, the first time and the second time being separated by at least 20 minutes;

wherein the second cut rate is no greater than 50% less than the first cut rate.

2. The structured abrasive article according to claim 1, wherein the second cut rate is no greater than 30% less than the first cut rate.

3. The structured abrasive article according to claim 2, wherein the second cut rate is no greater than 15% less than the first cut rate.

4. The abrasive article according to claim 1, wherein the ceramic aluminum oxide abrasive particles have an average particle size of about 300 micrometers.

5. The abrasive article according to claim 1, wherein the composites have a height, measured from the front face of the backing, of 750-1016 micrometers.

6. The abrasive article according to claim 1, wherein the ceramic aluminum oxide abrasive particles comprise ceramic aluminum oxide abrasive particles that have been modified with at least one rare earth oxide modifier.

7. The abrasive article according to claim 1, wherein the ceramic aluminum oxide abrasive particles comprise ceramic aluminum oxide abrasive particles that have been modified with an oxide of at least one of yttrium, neodymium, lanthanum, cobalt, and magnesium.

8. The abrasive article according to claim 1, wherein the ceramic aluminum oxide abrasive particles are seeded ceramic aluminum oxide abrasive particles.

9. The abrasive article according to claim 1, wherein the ceramic aluminum oxide abrasive particles are non-seeded ceramic aluminum oxide abrasive particles.

10. A method of grinding a surface, the method comprising:

(a) providing a structured abrasive article comprising a plurality of abrasive composites on the front face, each of the abrasive composites comprising:

(i) a plurality of ceramic aluminum oxide abrasive particles having an average particle size of about 300-400 micrometers dispersed in a binder;

(ii) having a height, measured from the front face of the backing, of 635-1016 micrometers; and (iii) faces that are defined at least partially by a parabolic function;

(b) grinding the surface at a first time to obtain a first cut rate and a first surface finish; and (c) grinding the surface at a second time at least 20 minutes after the first time to obtain a second cut rate being no greater than 50% less than the first cut rate.

11. The method according to claim 10, wherein grinding the surface at a second time comprises:

(a) grinding the surface at a second time to obtain a second cut rate being no greater than 30% less than the first cut rate.

12. The method according to claim 11, wherein grinding the surface at a second time comprises:

(a) grinding the surface at a second time to obtain a second cut rate being no greater than 15% less than the first cut rate.

13. The method according to claim 10, wherein grinding the surface at a second time comprises:

(a) grinding the surface at a second time 30 minutes after the first time.

14. A structured abrasive article comprising:

(a) a backing having a front face;

(b) a plurality of abrasive composites on the front face, each of the abrasive composites comprising:

(i) a plurality of ceramic aluminum oxide abrasive particles having an average particle size of about 300-400 micrometers;

(ii) an organic constituent comprising radiation curable binder, the organic constituent occupying 15-40 wt-% of the abrasive composite; the composites having a height, measured from the front face of the backing, of 635-1016 micrometers; and (iii) faces that are defined at least partially by a parabolic function;

wherein the abrasive article, when using Test Procedure I, produces a first cut rate at Cycle 1 and a second cut rate at Cycle 240, the second cut rate being no greater than 15% less than the first cut rate.

15. A structured abrasive article comprising:

(a) a backing having a front face;

(b) a plurality of abrasive composites on the front face, each of the abrasive composites comprising:

(i) a plurality of ceramic aluminum oxide abrasive particles having an average particle size of about 300-400 micrometers;

(ii) an organic constituent comprising radiation curable binder, the organic constituent occupying 15-40 wt-% of the abrasive composite; the composites having a height, measured from the front face of the backing, 635-1016 micrometers; and (iii) faces that are defined at least partially by a parabolic function;

wherein the abrasive article, when using Test Procedure II produces a first cut rate at Cycle 1 and a second cut rate at Cycle 12, the second cut rate being no greater than 50% less than the first cut rate.

16. A structured abrasive article comprising:

(a) a backing having a front face;

(b) a plurality of abrasive composites on the front face, each of the abrasive composites comprising:

(i) a plurality of ceramic aluminum oxide abrasive particles having an average particle size of about 300-400 micrometers;

(ii) an organic constituent comprising radiation curable binder, the organic constituent occupying 15-40 wt-% of the abrasive composite; the composites having a height, measured from the front face of the backing, of 635-1016 micrometers; and (iii) faces that are defined at least partially by a parabolic function;

wherein the abrasive article, when using Test Procedure III produces a first cut rate at Cycle 1 and a second cut rate at Cycle 30, the second cut rate is no greater than 30% less than the first cut rate.

17. A method of making an abrasive article comprising:

(a) providing a backing having a front face;

(b) applying a plurality of abrasive composites on the front face, each of the abrasive composites comprising:

(i) a plurality of ceramic aluminum oxide abrasive particles having an average particle size of about 300-400 micrometers;

(ii) an organic constituent comprising radiation curable binder, the organic constituent occupying 15-40 wt-% of the abrasive composite; the composites having a height, measured from the front face of the backing, of 635-1016 micrometers; and (iii) faces that are defined at least partially by a parabolic function.

18. The method of making the abrasive article according to claim 17, wherein the step of applying comprises:

(a) providing a slurry comprising a binder precursor and the plurality of ceramic aluminum oxide abrasive particles dispersed therein;

(b) providing a production tool having a plurality of cavities therein;

(c) coating the slurry into the cavities;

(d) contacting the slurry with the backing front face;

(e) at least partially curing the binder precursor having the plurality of ceramic aluminum oxide abrasive particles therein to form an at least partially cured binder having the plurality of ceramic aluminum oxide abrasive particles therein; and (f) removing the at least partially cured binder having the plurality of ceramic aluminum oxide abrasive particles therein from the production tool.

19. The method according to claim 18, wherein the step of coating the slurry into the cavities is done before the step of contacting the slurry with the backing front face.

20. The method according to claim 18, wherein the step of contacting the slurry with the backing front face is done before the step of coating the slurry into the cavities.

21. The method according to claim 18, wherein the step of providing a slurry comprises:

(a) providing a slurry comprising a binder precursor and ceramic aluminum oxide abrasive particles having an average particle size of about 300 micrometers.

22. The method according to claim 18, wherein the step of providing a slurry comprises:

(a) providing a slurry comprising a binder precursor and ceramic aluminum oxide abrasive particles wherein the ceramic aluminum oxide abrasive particles have been modified with at least one rare earth oxide modifier.

23. The method according to claim 18, wherein the step of providing a slurry comprises:

(a) providing a slurry comprising a binder precursor and ceramic aluminum oxide abrasive particles, wherein the ceramic aluminum oxide abrasive particles have been modified with an oxide from at least one of yttrium, neodymium, lanthanum, cobalt, and magnesium.

24. The method according to claim 17, wherein the step of applying a plurality of abrasive composites on the front face comprises:

(a) applying a plurality of abrasive composites, each of the abrasive composites having a height, measured from the front face of the backing, of 750-1016 micrometers.

25. The structured abrasive article according to claim 14, wherein the ceramic aluminum oxide abrasive particles have an average particle size of about 300 micrometers.

26. The structured abrasive article according to claim 15, wherein the ceramic aluminum oxide abrasive particles have an average particle size of about 300 micrometers.

27. The structured abrasive article according to claim 16, wherein the ceramic aluminum oxide abrasive particles have an average particle size of about 300 micrometers.

* * * * *

UNITED STATES PATENT AND TRADEMARK OFFICE

CERTIFICATE OF CORRECTION

PATENT NO. : 7,300,479 B2
APPLICATION NO. : 10/668753
DATED : November 27, 2007
INVENTOR(S) : James L. McArdle It is certified that error appears in the above-identified patent and that said Letters Patent is hereby corrected as shown below:

Column 1
Lines 34-37, delete the paragraph beginning with "Another" and ending with "4,773,920".

Column 3
Line 37, delete "wt %" and insert -- wt-% -- therefor.

Column 4
Line 22, delete "micrometers)." And insert -- micrometers)). -- therefor.
Line 48, delete "micrometers)." And insert -- micrometers)). -- therefor.

Column 8
Line 13, delete "Specialities." And insert -- Specialties. -- therefor.

Column 9
Line 22, delete "triacrylimdazoles," and insert -- triacrylimidazoles, -- therefor.
Line 22-23, delete "chloroalkytriazines," and insert -- chloroalkyltriazines, -- therefor.
Line 53, delete "that" and insert -- than -- therefor.
line 58, delete "gamet," and insert -- garnet, -- therefor.

Column 10
Lines 9-10, delete "tetrachloronaphtalene," and insert -- tetrachloronaphthalene, -- therefor.

Column 12
Line 32 (Table 1), delete "slilicate" and insert -- silicate -- therefor.

Column 15
Line 47, delete "Tol" and insert -- Tool -- therefor.

UNITED STATES PATENT AND TRADEMARK OFFICE

CERTIFICATE OF CORRECTION

PATENT NO. : 7,300,479 B2
APPLICATION NO. : 10/668753
DATED : November 27, 2007
INVENTOR(S) : James L. McArdle It is certified that error appears in the above-identified patent and that said Letters Patent is hereby corrected as shown below:

Column 20
Line 14, after "Procedure" delete "m" and insert -- III -- therefor.
Line 63, in Claim 1, before "635-1016" insert -- of --.

Column 22
Line 28, in Claim 15, before "635-1016" insert -- of --.

Signed and Sealed this

Nineteenth Day of August, 2008

JON W. DUDAS
*Director of the United States Patent and Trademark Office*